US008281945B2

(12) United States Patent
Roussy et al.

(10) Patent No.: US 8,281,945 B2
(45) Date of Patent: Oct. 9, 2012

(54) CLOSURE SYSTEM FOR CONTAINER

(75) Inventors: Michel Roussy, Lugrin (FR); Vincent Loisel, Thollon les Memises (FR)

(73) Assignee: SA des Eaux Minerales d'Evian SAEME, Evian-les-Bains (FR)

( * ) Notice: Subject to any disclaimer, the term of this patent is extended or adjusted under 35 U.S.C. 154(b) by 787 days.

(21) Appl. No.: 12/296,230

(22) PCT Filed: Apr. 5, 2007

(86) PCT No.: PCT/FR2007/000579

§ 371 (c)(1),
(2), (4) Date: Oct. 6, 2008

(87) PCT Pub. No.: WO2007/118995

PCT Pub. Date: Oct. 25, 2007

(65) Prior Publication Data

US 2009/0134116 A1 May 28, 2009

(30) Foreign Application Priority Data

Apr. 7, 2006 (FR) ..... 06 03117

(51) Int. Cl.
*B65D 41/04* (2006.01)

(52) U.S. Cl. ..... 215/333; 215/341; 215/344; 215/352

(58) Field of Classification Search ..... 215/317, 215/354, 329, 333, 341, 344, 346, 342, 352
See application file for complete search history.

(56) References Cited

U.S. PATENT DOCUMENTS

| | | | | |
|---|---|---|---|---|
| 2,014,093 | A * | 9/1935 | Terrill | 215/317 |
| 3,069,040 | A * | 12/1962 | Corsette | 215/318 |
| 3,224,617 | A * | 12/1965 | Hohl et al. | 215/44 |
| 3,286,868 | A * | 11/1966 | Mumford | 215/295 |
| 3,305,120 | A * | 2/1967 | Owen | 215/345 |
| 3,480,170 | A * | 11/1969 | Evans et al. | 215/215 |
| 3,741,423 | A * | 6/1973 | Acton et al. | 215/318 |
| 3,784,041 | A * | 1/1974 | Birch | 215/256 |
| 3,804,282 | A * | 4/1974 | Komendowski | 215/48 |
| 4,090,631 | A * | 5/1978 | Grussen | 215/329 |

(Continued)

FOREIGN PATENT DOCUMENTS

DE 20 61 936 6/1972

(Continued)

OTHER PUBLICATIONS

International Search Report dated Oct. 12, 2007, in PCT application.

*Primary Examiner* — Anthony Stashick
*Assistant Examiner* — Christopher McKinley
(74) *Attorney, Agent, or Firm* — Young & Thompson

(57) ABSTRACT

Closure system for a container including a cap and a ring adapted to engage by screwing in order to seal the opening, the cap including an upper wall from which in a downwards direction there extends an annular skirt that has a lower annular end and a radially inner surface fitted with a thread. The ring has an annular top rim, an annular collar and a thread complementary to the thread of the cap provided between the collar and the rim of the ring. The skirt of the cap includes a projecting annular member forming a barrier and adapted to be supported against the whole periphery of the collar of the ring in a substantially radial direction.

16 Claims, 1 Drawing Sheet

U.S. PATENT DOCUMENTS

| | | | | | |
|---|---|---|---|---|---|
| 4,125,201 | A | * | 11/1978 | Birch | 215/330 |
| 4,274,544 | A | * | 6/1981 | Westfall | 215/344 |
| 4,325,487 | A | * | 4/1982 | Libit | 215/330 |
| 4,380,304 | A | * | 4/1983 | Anderson | 220/782 |
| 4,540,102 | A | * | 9/1985 | Wiedmer | 215/344 |
| 4,595,547 | A | * | 6/1986 | Herr | 264/154 |
| 4,598,835 | A | * | 7/1986 | Brownbill | 215/307 |
| 4,645,088 | A | | 2/1987 | Menichetti | |
| 4,886,947 | A | * | 12/1989 | Thompson | 215/318 |
| 5,259,522 | A | * | 11/1993 | Morton | 215/344 |
| 5,275,287 | A | * | 1/1994 | Thompson | 215/344 |
| 5,667,089 | A | * | 9/1997 | Moore | 215/351 |
| 5,738,231 | A | * | 4/1998 | Montgomery | 215/44 |
| 5,743,420 | A | * | 4/1998 | Loffler et al. | 215/270 |
| 6,056,136 | A | * | 5/2000 | Taber et al. | 215/252 |
| 6,152,316 | A | * | 11/2000 | Niese | 215/252 |
| 6,202,870 | B1 | * | 3/2001 | Pearce | 215/307 |
| 6,371,319 | B2 | * | 4/2002 | Yeaton et al. | 215/352 |
| 6,382,445 | B1 | * | 5/2002 | McCandless | 215/341 |
| 6,913,157 | B2 | * | 7/2005 | Oh | 215/330 |
| 6,981,603 | B1 | * | 1/2006 | Mengeu et al. | 215/329 |
| 7,431,877 | B2 | * | 10/2008 | Druitt | 264/328.1 |
| 7,832,577 | B2 | * | 11/2010 | Shingle et al. | 215/217 |

FOREIGN PATENT DOCUMENTS

| | | | |
|---|---|---|---|
| GB | 893 058 | | 4/1962 |
| JP | 56160242 | U | 11/1981 |
| JP | 2005193913 | A | 7/2005 |

* cited by examiner

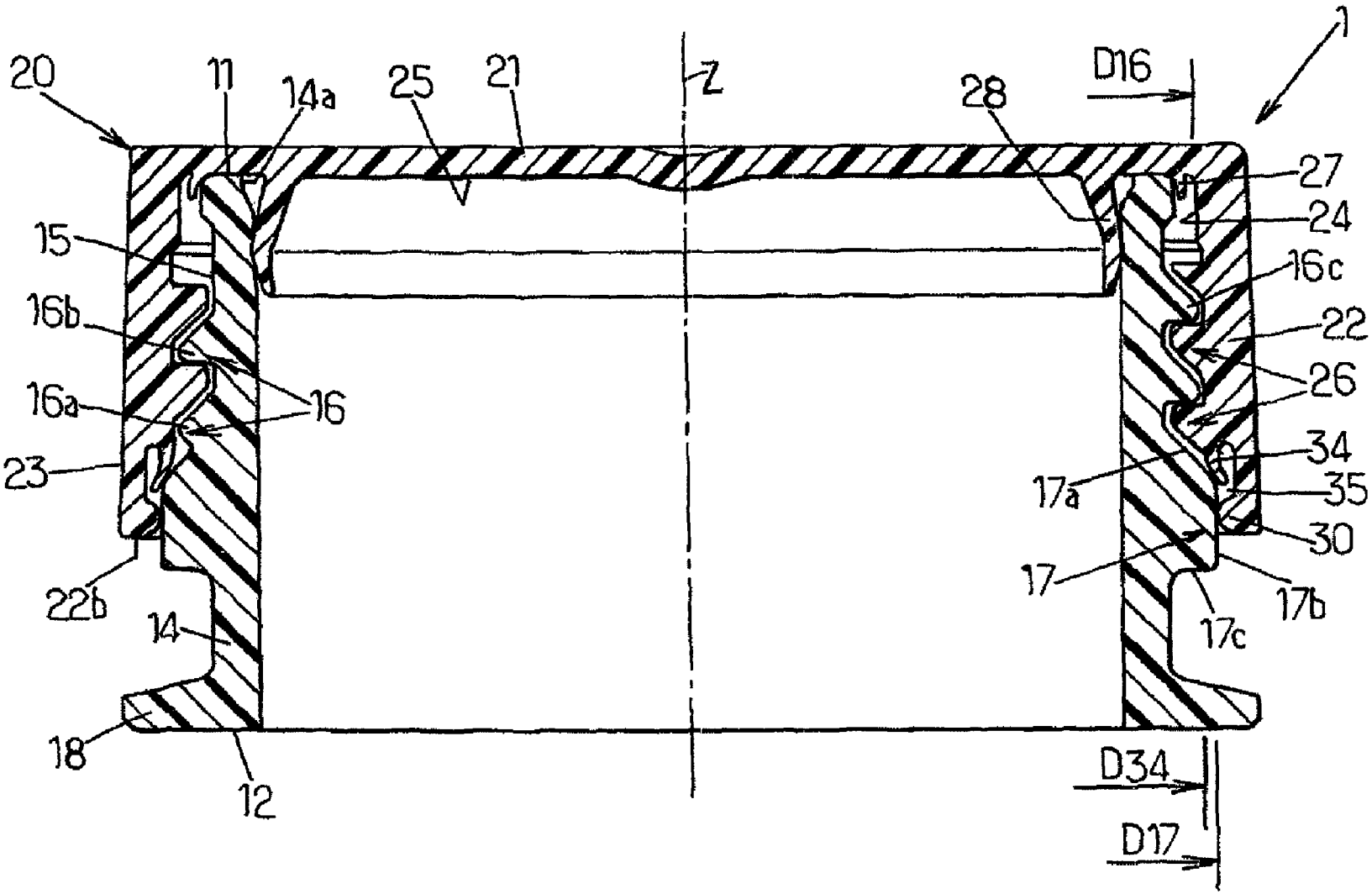
1
27
24
16c
22
26
34
35
30
17b
17c
D16
D34
D17
28
17a
17
Z
21
25
14a
11
16
12
14
20
15
16b
16a
23
22b
18

CLOSURE SYSTEM FOR CONTAINER

BACKGROUND OF THE INVENTION

This invention relates to a closure system for a container, comprising a cap and a ring defining a container opening, which are suitable for screw engagement to seal the opening.

More specifically, the cap comprises an essentially circular top wall from which there extends a downward annular skirt having an annular bottom edge and a radially inward face provided with a screw thread. The ring has an annular rim forming the opening of the container, an annular collar projecting out radially as far as a radially outermost face and a screw thread, complementary to the screw thread of the cap located between the collar and the rim of the ring.

Closure systems of this kind are very common, especially in the form of three-start thread caps for closing drinks bottles. These caps are usually supplied with sealing means which engage with the ring. For example, the cap may have an annular lip that contacts the internal upper portion of the ring, commonly termed the inner lip, and/or an outer lip that engages in a sealed manner with the outer periphery of the rim of the ring. With such lip systems the seal would seem to be completely satisfactory, because when the container is subjected to a large pressure difference between itself and the exterior, no liquid is observed to leak out or gas to get in, even after several hours of tests.

However, it has recently been found that under certain conditions, particularly during very long periods of transport during which the containers are exposed to adverse weather conditions, the radially outermost face of the ring can pick up chemical and/or microbiological contamination even into the screw threads. Although no health incident reported to date can be explained by the discovery of this possibility of contamination, it is preferable to limit it.

SUMMARY OF THE INVENTION

It is therefore an object of the invention to limit as far as possible contamination of the outermost face of the ring by the external environment.

For this purpose the subject of the present invention is a closure system of the type set out above, wherein the skirt of the cap comprises at least one annular barrier member which projects from the radially inward face and is adapted for bearing in an substantially radial direction against the entire periphery of the radially outermost face of the collar.

At least one barrier is thus formed between the ring and the cap on the collar. That portion of the outermost face of the ring which is above the collar is thus protected from external contaminants.

This upper portion of the ring is to be protected as a priority because it is possible that when the liquid is being poured out, contaminants deposited near the rim of the ring may be entrained with the liquid, or a user may place this portion of the ring in contact with his mouth when drinking from the mouth of the bottle. It will be observed that this arrangement can be put into practice quite easily because only the cap requires substantial modifications compared with existing caps. Specifically, it is usual on standardized rings developed for mass production to provide an annular collar with an inclined longitudinally upper face, allowing the fitting and retention of a tamper-evident ring connected to the lower end of the cap by breakable bridges. It will also be observed that a reasonably large buffer area is created between the resulting barrier and the normal sealing means of the cap that come into contact with the rim of the ring, thereby considerably retarding the potential migration of contaminants towards these sealing means.

It will be understood that the fact that this barrier is formed by a projecting member reduces the area of contact between the cap and the collar, and in any case limits this area to the dimensions of the projecting member. The contact pressure is therefore relatively high and the projecting member is deformable to better adjust to the collar. Whereas, in the case of large areas, the contact pressure is low and a localized surface defect, for example on the inward face of the skirt, can create a passage through the barrier.

In addition, the fact that the bearing force is exerted in an approximately radial direction on the outermost face of the collar, including the upper and lower limits of this face, also reinforces the leaktightness of the barrier. In the first place, the force of such pressure is not significantly affected by slight variations in the longitudinal position of the projecting member, and hence to how far down the cap is screwed, because the outermost face extends essentially in the longitudinal direction of the ring. In the second place, the cap skirt is capable of being deformed radially by a comparatively large amount, certainly much more than in the longitudinal direction. Also, the projecting member is better able to fulfil its barrier function in spite of certain variations in the outside diameter of the collar.

Preferred embodiments of the invention also make use of any of the following provisions:

- said at least one barrier member is formed by an annular bead projecting from the inward face of the skirt of the cap in a radially inward direction;
- the bead has an inside diameter that is less than the outside diameter of the collar, and the skirt of the cap is capable of tolerating an outward radial deformation when said bead engages on a longitudinally upper face of said collar;
- said at least one barrier member is formed by an annular lip extending from the inward face of the skirt of the cap and constructed so as to be deformed on contact with the collar of the ring;
- the annular lip extends essentially downwards and preferably forms a continuation of the inward face of the skirt; this limits the radial size of the barrier member and prevents interference with the thread of the ring when a cap is being put on;
- a peripheral recess is formed in the skirt of the cap adjacent to the annular lip and externally relative to the latter; this increases the range of radial elastic movement of the lip to ensure contact between the collar and lip in spite of manufacturing tolerances;
- the collar has a longitudinally upper face connecting the ring to the radially outermost face, said upper and outermost faces being connected by an outline essentially in the shape of an arc of a circle;
- the screw thread of the ring is within a predetermined maximum outside diameter, and said at least one barrier member does not extend inwards further than a minimum diameter greater than said predetermined maximum diameter;
- said at least one barrier member is close to the annular bottom edge of the cap;
- the cap also comprises sealing means extending from its top wall and engaging with the ring close to the annular rim of said ring; and
- a plurality of barrier members are provided.

Other features and advantages will become apparent in the course of the following description, given by way of nonrestrictive example, with reference to FIG. 1, which is a simplified cross section through a closure system comprising two barrier members produced in accordance with the invention.

BRIEF DESCRIPTION OF THE DRAWING

FIG. 1 shows a closure system 1 comprising a ring 10 and a cap 20.

DETAILED DESCRIPTION OF THE PREFERRED EMBODIMENT

The ring 10 has an annular rim 11 that defines the opening of a container which is not shown but which extends from an annular bottom edge 12 of the ring 10 and may be made in any known manner. As an example, this container may be formed by thermo-blow molding a PET preform that includes the ring 10 and is formed in one piece with said ring.

The ring 10 is in itself of known type, unless otherwise indicated below. It is preferably a standard ring, especially a three-start threaded ring, so that putting the invention into practice requires virtually no modification of the ring 10 and as few modifications as possible to the cap 20.

The ring 10 is formed by a cylindrical annular wall 14 extending around a central axis Z of the annular rim 11 at the bottom edge 12. It is possible to have variations of thickness in this annular wall 14 or recesses in it, typically towards the annular rim 11 to save plastic or for reasons of leaktightness.

For example, the inward periphery of the rim 11 of the ring has a recess 14*a* so that this inward periphery is radially further out than the line of the wall 14. This provision ensures that a defect, caused for example by a blow to the rim 11, does not extend further than the inside diameter of the ring and does not subsequently interfere with a sealing lip.

The ring 10 has a radially outermost face 15 with respect to the central axis Z of this ring. A screw thread 16 occupies a longitudinal portion of the outermost face 15, beginning a certain distance below the rim. The screw thread has three starts separated by angles of 120° which as is well known makes the cap 20 easier to screw on and off. The threads (16*a*, 16*b*, 16*c*) are asymmetrical in profile, with an inclined longitudinally upper face to allow the cap to be fitted in a known manner along the Z axis.

The ring 10 has an annular collar 17 beneath the screw thread 16. This collar is in the form of an annular protuberance projecting radially outwards from the annular outermost face 15. More precisely, the collar 17 has a longitudinally upper face 17*a* which slopes down, that is to say it extends from the annular wall 14 in such a way as to form in general terms an acute angle with a central axis Z. The collar 17 also has a generally cylindrical annular outermost face 17*b* of diameter D17 coaxial with the central axis Z, and a longitudinally lower face 17*c* extending approximately at right angles to the annular wall 14. A collar of this kind is normally designed to engage with a tamper-evident band connected to the cap, the inclined longitudinally upper face 17*a* allowing the passage of lugs for retaining the tamper-evident band and the longitudinally lower face forming a member for the retention of this band. The collar 17 is often referred to as a tamper-evident collar because of this function.

At a distance from the collar 17 there is usually formed a second collar 18 whose longitudinally lower face 18*c* is usually used as a reference for defining the bottom edge 12 of the ring 10. This second collar 18, which is usually of a larger outside diameter and of a smaller height, is used for carrying the bottles.

It will be seen that, in the embodiment illustrated, the base of the screw threads (16*a*, 16*b*, 16*c*) extends from the collar 17, and more precisely that the base of these threads begins on the longitudinally upper face 17*a*, as is visible on the left-hand side of FIG. 1 in the case of screw thread 16*a*. Also, the screw threads advantageously occupy a large angular sector of some 180 to 230°, rather than the 120 to 140° usually used on three-start rings. The advantage of this is that it increases the overlap between each of the threads (16*a*, 16*b*, 16*c*) and thus increases the linear length of the radial gap between the threads 16 on the ring and the complementary threads on the cap, this gap being needed to absorb the manufacturing tolerances between the ring 10 and the cap 20. Provision is thus made to slow the migration of any contaminants along the thread 16 towards the rim 11 of the ring.

To this end, it is also possible to give the thread a shorter effective pitch than is normally used—for example an effective pitch of between 5 and 12 millimeters and preferably a pitch of 8 millimeters, to further increase the length of the threads (16*a*-16*c*) and hence their angular overlap. However, this requires a significant modification of the ring and is detrimental to compatibility with existing caps.

The cap 20 has a top wall 21 of circular and essentially planar shape and a peripheral annular skirt 22 that extends down from the periphery of the top face 21. In the embodiment illustrated, the cap 20 is therefore of generally cylindrical outer shape, but it is perfectly possible to adopt more complex shapes, in order for example to improve the appearance of the cap or to form gripping means on an annular outermost face 23 of the skirt 22.

The skirt 22 of the cap has a radially inward annular face 24 on which a thread 26 extends radially inwards. The thread 26 is of course complementary to the thread 16 of the ring to allow the two to be screwed together, and is designed in such a way that the cap 20 can be screwed down until the inward face 25 of the top wall 21 meets the rim 11 of the ring 10.

An annular lip 28, termed the inner lip, extends downwards from the top wall 21 of the cap and has a circumferential profile adapted to make contact with the interior of the annular wall 14 of the ring and thus form a first sealing means as is known. It will be observed that the profile of the lip 28 is chosen to make contact beneath the recess 14*a* formed at the rim 11. Thus, if the inward periphery of the annular rim 11 has a defect, it will not interfere with the inner lip 28, and leaktight contact between this lip and the ring is maintained.

An annular lip 27, termed the outer lip, also extends downwards from the top wall 21, but its diameter is greater than that of the inner lip 28 so that it bears against the outer periphery of the rim 11 of the ring. The outer lip forms a second sealing means preventing the escape of liquid contained in the container and the entry of air.

Although not shown in FIG. 1 for reasons of simplification, it should be noted that the cap 20 is normally provided with a tamper-evident band co-cylindrical with the skirt 22 and connected to the latter's annular bottom edge 22*b* by breakable bridges. This tamper-evident ring comprises in a known manner lugs projecting towards the central axis Z and designed to engage with the longitudinally lower face 17*c* of the collar 17.

The radially inward face 24 of the skirt 22 has an annular bead 30 projecting towards the central axis Z. In the embodiment illustrated, the bead 30 has a constant circumferential profile which is a semicircle arranged so that the nose of the bead 30, that is the point closest to the central axis Z, is in the center of this semicircle.

The bead 30 is located on the inward face 24 and has a predetermined inside diameter, measured between two diametrically opposite points on the nose, such that the bead 30 makes bearing contact all the way around the perimeter of the collar 17 of the ring. More particularly, in the embodiment illustrated, the circular line defined by the nose of the bead 30 lies on the outermost face 17*b* of the collar. This contact preferably involves creating a radial elastic deformation of the skirt 22 of the cap 20 so that the pressure applied by the bead 30 to the collar 17 is significant and there are no gaps between them. This also allows the skirt 22 of the cap 20 to absorb certain variations in the outside diameter of the collar 17. The bead 30 thus constitutes a first barrier member between the cap 20 and the ring 10, thereby gradually limiting or even preventing the ingress of external contaminants into the space between the radially outermost face 15 of the ring and the radially inward face 24 of the cap.

More particularly, the bead 30 is located in a plane lying transversely relative to the central axis Z and adjacent to the bottom annular edge 22*b* of the skirt in order to protect as much of the height of the upper portion of the ring 10 as possible.

To ensure that the contact involves a stress of elastic deformation, the inside diameter of the bead 30 should be less than the outside diameter D17 measured on the outermost face 17*b* of the collar when the cap 20 is not mounted on the ring. When the cap 20 is mounted, the bead 30 makes contact with the longitudinally upper face 17*a* of the collar, the bottom portion of the skirt 22 deforms radially outwards, and, once the cap is in place, its skirt 22 flares out very slightly downwards, as can be seen in FIG. 1. The contact force is therefore exerted in a radial direction and is therefore little affected by the longitudinal position of the nose of the bead 30 on the radially outermost face 17*b* of the collar. The inside diameter of the bead 30 is however chosen to bring about only an elastic deformation of the skirt, and in such a way as not to require too great an effort to unscrew it or screw it on.

It will be seen that the longitudinally upper face 17*a* is connected to the outermost face 17*b* of the collar 17 by a profile in the shape of an arc of a circle rather than by a sharp angle. This is to facilitate the sliding of the bead 30 over these faces (17*a*, 17*b*), a movement facilitated by the semicircular profile of the bead, and is also designed to save the bead from being damaged. However, it is perfectly possible to have a different profile for the bead 30, such as a wedge-shaped profile.

The skirt 22 of the cap also has an annular lip 34 that is elastically deformable and located on the inward face to allow it to make contact with the collar 17. In a similar way to the bead 30, this contact involves elastic deformation of the lip 34 to give continuous contact all the way around the perimeter of the collar 17 and thus act as a second barrier member effective against external contaminants.

As FIG. 1 shows, the base of the lip 34 is geometrically a continuation of the inward face 24 of the skirt and, in the undeformed state, is geometrically a continuation of the upper part of this face, but is offset towards the center compared with that portion of this inward face which is adjacent to this lip 34, which therefore protrudes. The shape of the lip 34 is therefore a cylinder coaxial with the central axis Z. In order to provide a space for a radially outward deformation of the lip, a peripheral recess 35 is formed in the skirt 22 adjacent to and on the outside of the lip 34. The lip made in accordance with this preferred embodiment has the advantage of having a radial dimension, that is to say a minimum inside diameter D34 in the undeformed state, which approximately equals the diameter of the inward face 24 of the cap. This inside diameter D34 is greater than the maximum outside diameter D16 of the thread 16 of the cap. This ensures that the lip 34 is not damaged by the thread 16 of the ring being screwed on.

In the embodiment depicted, the lip 34 contacts the collar 17 via the lip's inward lateral face against the upper rim of the outermost face 17*b* of the collar. The direction of the force with which this contact is applied is therefore more or less inclined relative to a radial direction, depending on the diameter and shape of the upper part of the collar 17. However, the contact with the collar 17 can occur via the free edge of the lip, in which case the free edge of the lip 34 may be given a special profile, such as a beveled profile for correct positioning.

Again, the configuration of the lip 34 could be significantly different. It could for example be inclined towards the central axis Z, or even more or less perpendicular to this axis, and could experience radial deformation towards the center when the cap reaches the closed position shown in FIG. 1. However, in such configurations the lip would be much larger in the radial dimension, which could be detrimental to the positioning or screwing on of the cap, or could necessitate more significant changes to the cap.

In the embodiment illustrated, there are therefore two members (30, 34) forming barriers against external agents in the vicinity of the bottom edge 22*b* of the cap. What is more, these structurally significantly different members—the bead 30 and the lip 34—each have different advantages in terms of the risk of damage and the quality of the seal. This double barrier therefore reduces very greatly the risk of contamination. In addition, there is a combined effect with the sealing means formed by the inner and outer lips (27, 28) which block the entry of gas through the mouth of the bottle. The barrier members (30, 34) form with the sealing means (27, 28) a closed space in which such movements of gas or liquid could encourage the migration of contaminants towards the interior are nonexistent.

The embodiment illustrated is in no way restrictive. Other shapes and arrangements of the barrier members (30, 34) are possible. For instance, they could be made a different shape, but they could also be different in terms of number and arrangement. Purely as an indication, it is possible to have a double annular bead making contact with the outermost face 17*b* of the collar and two lips making contact with the longitudinally upper face 17*a* of the collar, one lip optionally being deformed outwards and the other inwards. The barrier member can also be made in the form of a lip instead of the bead 30.

The invention claimed is:

1. A closure system for a container, comprising:

a cap; and a ring defining a container opening, wherein said cap and ring are configured for screw engagement to seal the opening, said cap comprising an essentially circular top wall from which there extends a downward annular skirt having an annular bottom edge and a radially inward face provided with a screw thread, said ring having an annular rim forming said opening, an annular collar projecting out radially as far as a radially outermost face and a screw thread, complementary to the screw thread of the cap located between the collar and the rim of the ring, wherein said skirt of the cap comprises at least one annular barrier member which projects from said radially inward face and is adapted for bearing in a substantially radial direction against the entire periphery of said radially outermost face of the collar, and wherein said skirt of the cap and said at least one barrier member are formed integrally of one piece of a same material.

2. The closure system as claimed in claim 1, wherein said at least one barrier member is formed by an annular bead projecting from said inward face of the skirt of the cap in a radially inward direction.

3. The closure system as claimed in claim 2, wherein said bead has an inside diameter that is less than the outside diameter of the collar, and wherein said skirt of the cap is capable of tolerating an outward radial deformation when said bead engages on a longitudinally upper face of said collar.

4. The closure system as claimed in claim 1, wherein said at least one barrier member is formed by an annular lip extending from said inward face of the skirt of the cap and constructed so as to be deformed on contact with said collar of the ring.

5. The closure system as claimed in claim 4, wherein said annular lip extends essentially downwards.

6. The closure system as claimed in claim 5, wherein said annular lip forms a continuation of the inward face of the skirt.

7. The closure system as claimed in claim 4, wherein a peripheral recess is formed in said skirt of the cap adjacent to said annular lip and externally relative to said annular lip.

8. The closure system as claimed in claim 1, wherein said collar has a longitudinally upper face connecting said ring to the radially outermost face, said upper and outermost faces being connected by an outline essentially in the shape of an arc of a circle.

9. The closure system as claimed in claim 1, wherein said screw thread of the ring is within a predetermined maximum outside diameter, and wherein said at least one barrier member does not extend inwards further than a minimum diameter greater than said predetermined maximum diameter.

10. The closure system as claimed in claim 1, wherein said at least one barrier member is close to the annular bottom edge of the cap.

11. The closure system as claimed in claim 1, wherein said cap also comprises sealing means extending from its top wall and engaging with said ring close to said annular rim of said ring.

12. The closure system as claimed in claim 1, wherein said skirt of the cap comprises a plurality of barrier members each arranged closer to the annular bottom edge of the cap than the screw thread of the cap.

13. The closure system as claimed in claim 1, wherein said skirt of the cap is part of a single piece made of a same plastic.

14. The closure system as claimed in claim 13, wherein said skirt of the cap has an outer face extending from said top wall as far as said annular bottom edge, said outer face of the skirt defining a constant outer diameter of the skirt.

15. A closure system for a container, comprising:

a cap; and a ring defining a container opening, wherein said cap and said ring are suitable for screw engagement to seal the opening, said cap comprising an essentially circular top wall from which there extends a downward annular skirt having an annular bottom edge and a radially inward face provided with a screw thread, said ring having an annular rim forming said opening, an annular collar projecting out radially as far as a radially outermost face and a screw thread, complementary to the screw thread of the cap located between the collar and the rim of the ring, wherein said skirt of the cap comprises an annular barrier member which projects from said radially inward face and is adapted for bearing in a substantially radial direction against the entire periphery of said radially outermost face of the collar, and wherein a peripheral recess is formed in said skirt of the cap, said peripheral recess being adjacent to said barrier member, the barrier member being arranged closer to the annular bottom edge of the cap than the peripheral recess, wherein said cap is formed integrally of one piece of material.

16. The closure system as claimed in claim 15, wherein the material of said cap is a plastic material.

* * * * *